US005607287A

United States Patent [19]

Ikeda et al.

[11] Patent Number: 5,607,287

[45] Date of Patent: Mar. 4, 1997

[54] RECIPROCATING PISTON TYPE COMPRESSOR WITH AN IMPROVED DISCHARGE VALVE MECHANISM

[75] Inventors: Hayato Ikeda; Hisato Kawamura; Hiromi Michiyuki; Masanobu Yokoi, all of Kariya, Japan

[73] Assignee: Kabushiki Kaisha Toyoda Jidoshokki Seisakusho, Aichi, Japan

[21] Appl. No.: 570,541

[22] Filed: Dec. 11, 1995

[30] Foreign Application Priority Data

Dec. 16, 1994 [JP] Japan ..... 6-313620

[51] Int. Cl.[6] ..... F04B 1/16

[52] U.S. Cl. ..... 417/269; 417/569

[58] Field of Search ..... 417/269, 569

[56] References Cited

U.S. PATENT DOCUMENTS 4,749,340 6/1988 Ikeda et al. ..... 417/269
4,836,754 6/1989 Ikeda et al. ..... 417/269
4,880,361 11/1989 Ikeda et al. ..... 417/269
4,990,064 2/1991 Ikeda et al. ..... 417/269
5,100,306 3/1992 Moran et al. ..... 417/269 X

*Primary Examiner*—Richard E. Gluck
*Attorney, Agent, or Firm*—Burgess, Ryan and Wayne

[57] ABSTRACT

A reciprocating piston type compressor having a cylinder block, a plurality of cylinder bores, and at least a housing closing an end of the cylinder block. The housing contains a suction chamber for a refrigerant gas to be compressed and a discharge chamber for the compressed refrigerant gas discharged from the cylinder bores in response to reciprocation of a plurality of pistons. The compressed gas is discharged through discharge ports closed by a discharge valve element having a plurality of integral discharge reed-valves movable between a closed positions and a predetermined open positions. The open position is defined by a stop unit integrally formed in an inner wall of the housing. The stop unit has a plurality of flat stop faces formed on the inner wall to permit free ends of the discharge reed-valves to come into contact engagement therewith, when the discharge reed-valves are moved from the closed positions to the open positions.

7 Claims, 4 Drawing Sheets

RECIPROCATING PISTON TYPE COMPRESSOR WITH AN IMPROVED DISCHARGE VALVE MECHANISM

BACKGROUND OF THE INVENTION

1. Field of the Invention

The present invention generally relates to a reciprocating piston type refrigerant compressor, and more particularly, the present invention relates to an improvement in the discharge valve mechanism incorporated in the reciprocating piston type refrigerant compressor.

2. Description of the Related Art

The conventional reciprocating piston type compressor is provided with a plurality of either single headed pistons or double-headed pistons reciprocating in the associated cylinder bores to implement suction, compression and discharge of the refrigerant gas. The compressed gas discharged from the cylinder bores is delivered to an air-conditioning system or a climate control system of, for example, an automobile. The reciprocation of the pistons is caused by the rotation of a swash plate or the non-rotating nutating motion of a wobble plate which is driven by the rotation of the drive shaft. The discharge of the compressed gas from the respective cylinder bores is controlled by a discharge valve mechanism. The discharge valve mechanism includes discharge ports formed in an end wall (usually, a valve plate) covering an end of each of the respective cylinder bores, a discharge chamber formed in a housing or housings and communicating with the respective cylinder bores for receiving the compressed gas discharged from the cylinder bores, a discharge valve assembly having a plurality of integrally formed reed-valves, and a valve retainer assembly for retaining the respective reed-valves at the respective opening positions thereof. The discharge valve assembly and the valve retainer assembly are held in the interior of the compressor either by an appropriate fixing means or by being attached to a wall portion of the housing.

FIG. 5 illustrates a typical arrangement of one part of the conventional discharge valve mechanism of the reciprocating piston type compressor. As shown in FIG. 5, the discharge valve mechanism arranged between a housing "A" and a valve plate "B" includes a discharge port "b" formed in a valve plate "B". The discharge port b is covered by a reed-valve "d" movable from an opening position backed up by a valve retainer "a" toward its closing position in contact with a valve seat "C" of the valve plate "B" to close the port "b". The valve retainer "a" is held between the housing "A" and the valve plate "B", and provided with a support portion gradually curving away from the valve seat "C" into the discharge chamber defined in the housing "A". The support portion of valve retainer "a" backs up the entire portion of the rear face of the reed valve "d". A flow passage defined between the port "b" and the reed valve "d", moved to its opening position, is so narrow that the compressed gas discharging into the discharge chamber from each cylinder bore through the flow passage is subjected to a large resistance. Namely, the discharging of the compressed gas consumes considerable power, and accordingly, the power for driving the compressor must be large. The large power requirement results in the application of a large load to a drive source such as an automobile engine.

Further, the use of the retainer "a" is not desirable from the viewpoint of reducing the number of parts or elements necessary for assembling the reciprocating piston type compressors. Moreover, since the retainer "a" is usually produced by plastic deformation of a metallic plate, the dimensional accuracy of the retainer "a" is low due to the spring back of the metallic plate. Thus, the retainer "a" is unable to accurately determine an opening position of the discharge reed valve "d".

SUMMARY OF THE INVENTION

Therefore, an object of the present invention is to provide a reciprocating piston type compressor provided with a discharge valve mechanism which is able not only to back up the discharge reed valves without using the conventional valve retainer but is also able to reduce the resistance against the flow of the compressed gas discharged from the cylinder block into the discharge chamber.

Another object of the present invention is to provide a reciprocating piston type compressor provided with a discharge valve mechanism having a novel internal construction for accurately determining the opening position of the discharge reed valves within the discharge cheer of the compressor.

In accordance with the present invention, there is provided a reciprocating piston type compressor comprising:

- a cylinder block having therein a shaft bore and a plurality of cylinder bores arranged around the shaft bore;
- a drive shaft rotatably supported in the shaft bore via anti-friction bearings, and supporting thereon a swash plate element;
- a plurality of pistons operatively engaged with the swash plate element and reciprocating in the plurality of cylinder bores for implementing suction, compression, and discharge of a refrigerant gas in response to the rotation of the drive shaft;
- at least a housing closing an end of the cylinder block and having an inner wall defining a discharge chamber for receiving the refrigerant gas after being compressed and discharged from each of the plurality of cylinder bores through each discharge port bored in an end wall means covering the end of each of the cylinder bores;
- a discharge valve element held between the housing and the cylinder block, and including a plurality of movable discharge reed-valves operative to close and open the discharge ports, each movable discharge valve having a free end thereof; and,
- a valve stop means integrally formed in the inner wall of the housing at positions exposed to the discharge chamber, the valve stop means being arranged to be engaged with the free end of each of the plurality of discharge reed-valves to thereby determine an open position of each of the discharge valves when each movable discharge reed-valve is moved from a closed position thereof to the open position thereof.

Preferably, the inner wall of the housing is provided with a plurality of supporting portions arranged at positions facing each of the movable discharge reed-valves so as to support gradual bending of the movable discharge reed-valves when the plurality of movable discharge reed-valves are moved from the closed positions to the open positions thereof.

Preferably, the valve stop means comprises a plurality of protrusions formed in the inner wall of the housing. The protrusions define a plurality of flat seating faces with which the free ends of the plurality of movable discharge reed-valves come in face-to-face contact when the reed-valves are moved to the open positions thereof.

BRIEF DESCRIPTION OF THE DRAWINGS

The above and other objects, features and advantages of the present invention will be made more apparent from the ensuing description of preferred embodiments thereof in conjunction with the accompanying drawings wherein.

DESCRIPTION OF THE PREFERRED EMBODIMENTS

Figure 1:
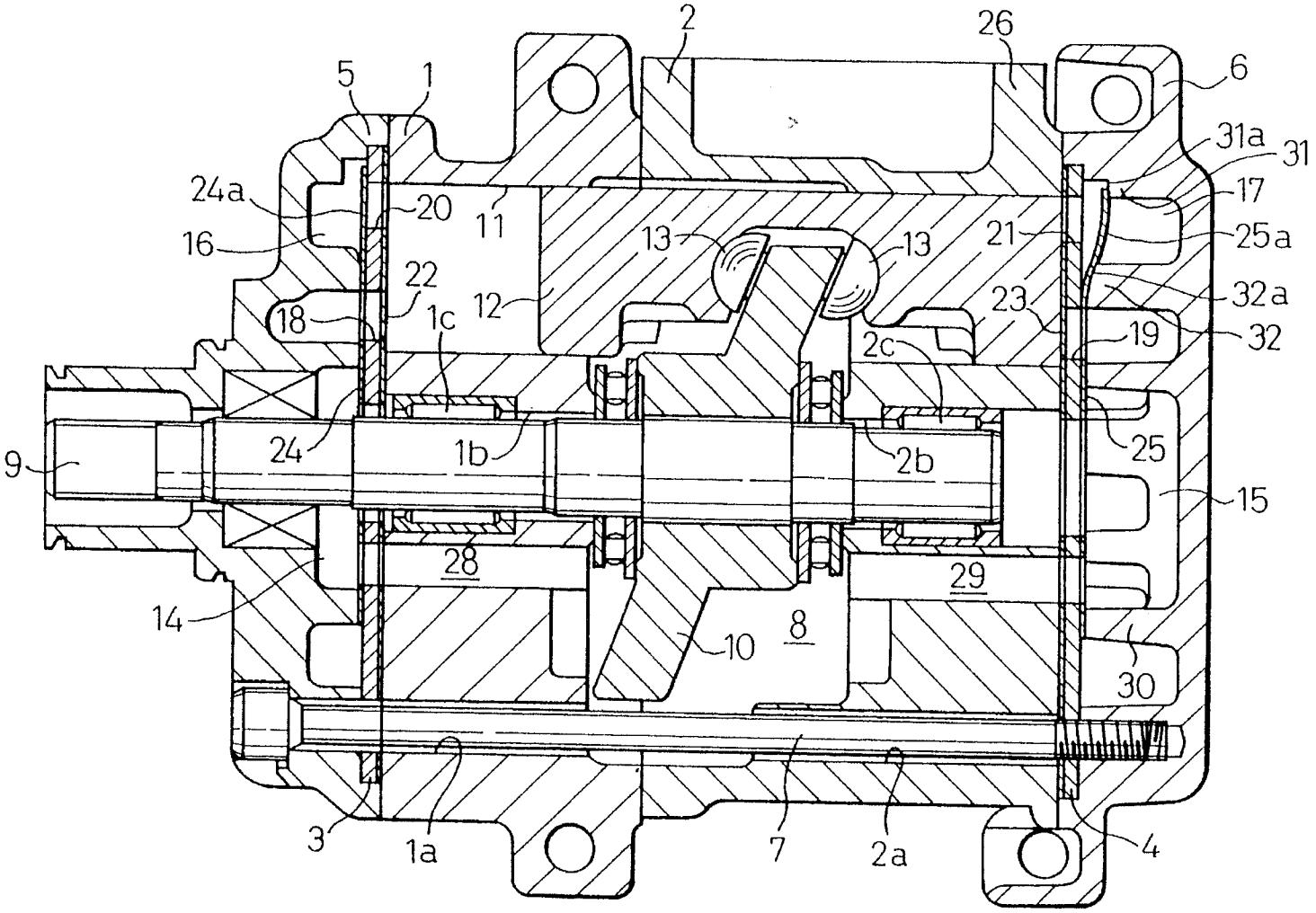
FIG. 1 is a longitudinal cross-sectional view of a reciprocating piston type compressor provided with an improved discharge valve mechanism, according to an embodiment of the present invention.
Figure 2:
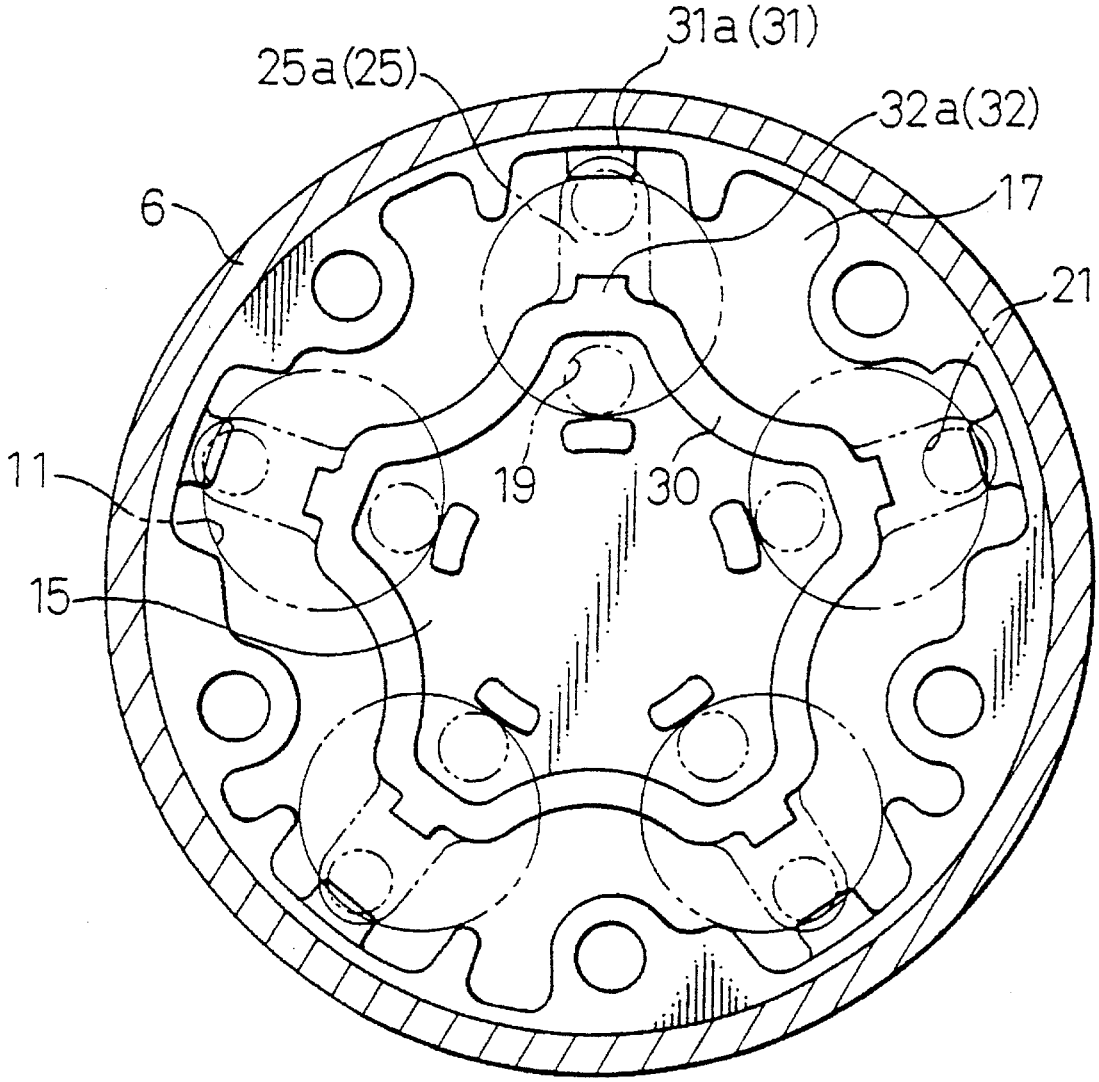
FIG. 2 is a side view of a rear housing of the compressor of FIG. 1.

Referring to FIGS. 1 and 2, a double-headed reciprocating piston type compressor is constructed so as to have five cylinder bores on each of the axially front and rear ends thereof. The compressor has front and rear cylinder blocks 1 and 2 axially connected to one another so as to form an integral cylinder block assembly. The cylinder block assembly has front and rear ends closed by front and rear housings 5 and 6, via front and rear valve plates 3 and 4. The front and rear cylinder blocks 1 and 2, front and rear valve plates 3 and 4, and front and rear housings 5 and 6 are tightly combined by axial long screw bolts 7 which are inserted into coaxial through-bores 1*a* and 2*a*. The cylinder block assembly has a swash plate chamber 8 formed at a position corresponding to the connecting portion of the front and rear cylinder blocks 1 and 2. The cylinder block assembly also has an axial central bore including coaxial front and rear bores 1*b* and 2*b* formed in the front and rear cylinder blocks 1 and 2, respectively. The central bore supports an axial drive shaft 9 via front and rear anti-friction bearings 1*c* and 2*c*, and the drive shaft 9 mounts thereon a swash plate 10 rotating together with the drive shaft 9 in the swash plate chamber 8.

The cylinder block assembly is provided with the aforementioned axial cylinder bores 11, i.e., five front cylinder bores and five coaxial rear cylinder bores substantially equidistantly arranged around the axis of rotation of the drive shaft 9. Five double-headed pistons 12 are received in the axial cylinder bores 11, and engaged with the swash plate 10 via semi-circular shoes 13. The pistons 12 are reciprocated by the swash plate 10 in response to the rotation of the swash plate 10.

The front and rear housings 5 and 6 are provided with central suction chambers 14 and 15, and radially outer discharge chambers 16 and 17 formed therein, respectively. The front and rear valve plates 3 and 4 have suction ports 18 and 19 bored therein, respectively, so as to provide a fluid communication between the suction chambers 14 and 15 and the respective cylinder bores 11. The front and rear valve plates and 4 also have discharge ports 20 and 21 bored therein, respectively, so as to provide a fluid communication between the respective cylinder bores 11 and the discharge chambers 16 and 17. Namely, the suction ports 18 and 19 permit low pressure refrigerant gas to enter the respective cylinder bores 11 to be compressed by the compressing stroke of the double-headed pistons 12. The discharge ports 20 and 21 permit high pressure compressed refrigerant gas to be discharged from the cylinder bores 11 into the discharge chambers 16 and 17 by the compression stroke of the double-headed pistons 12.

The suction ports 18 and 19 are closed by suction valve elements 22 and 23 in the form of reed-valves arranged to be in contact with inner faces of the front and rear valve plates 3 and 4, i.e., the faces confronting the ends of the cylinder block assembly. Similarly, the discharge ports 20 and 21 are closed by discharge valves elements 24 and 25 in the form of reed-valves arranged to be in contact with the outer faces of the front and rear valve plates 3 and 4, i.e., the faces confronting the front and rear housings 5 and 6.

The suction and discharge valve elements 22, 23, 24, and 25 can be moved away from the suction and discharge ports 18, 19, 20, and 21 so as to open the respective ports.

The rear cylinder block 2 is provided with an outer bracket 26 arranged to be connected to a non-illustrated flange member. The bracket 26 is provided with an inlet port (not shown in FIGS. 1 and 2) bored therein so as to introduce refrigerant gas to be compressed from an external refrigerating system into the swash plate chamber 8. The refrigerant gas introduced into the swash plate chamber 8 is further introduced into the suction chambers 14 and 15 through a plurality of axial suction passageways 28 and 29 formed between the respective two neighboring cylinder bores 11.

The above-mentioned bracket 26 is also provided with a delivery port (not shown in FIGS. 1 and 2) bored therein so as to deliver the compressed refrigerant gas from the discharge chambers 16 and 17 of the front and rear housings 5 and 6 through delivery passageways (not shown in FIGS. 1 and 2) provided in the front and rear cylinder blocks 1 and 2.

The reciprocating piston type refrigerant compressor provided with the above-mentioned construction is characterized in that the discharge valve mechanism including the above-mentioned discharge valve elements 24 and 25, and discharge ports 20 and 21 of the front and rear valve plates 3 and 4 is provided with a novel valve open position defining means without employing the conventional valve retainer elements.

The discharge valve mechanism will be described in more detail with reference to FIG. 4, typically illustrating the valve open position defining means provided for the discharge valve element 25 arranged on the rear side of the compressor, as well as the illustration of FIG. 1.

The rear discharge valve element 25 is made of a thin resilient sheet material, such as a thin metallic sheet, and is provided with a plurality of reed-valves 25*a* integrally formed therein so as to ordinarily close the respective cylinder bores 11 at the rear ends of the cylinder block 2. Namely, the number of the reed-valves 25*a* of the discharge valve element 25 corresponds to the number of the cylinder bores 11, i.e., five in the case of the present embodiment. The discharge valve element 25 is sandwiched between a pentagonally extending wall 30 formed in an inner face of the rear housing 6 and the outer face of the rear valve plate 4. The wall 30 of the rear housing 6 is provided for fluidly isolating the discharge chamber 17 from the central suction chamber 15.

The respective reed-valves 25*a* of the discharge valve element 25 extend radially from a base portion at which the discharge valve element 25 is held between the wall 30 of the rear cylinder block 6 and the rear valve sheet 4 toward the respective discharge ports 21. The valve element 25 is ordinarily in contact with the outer face, i.e., the valve seat face 4*a* of the valve plate 4 so as to take a position closing the discharge port 21. The reed-valves 25*a* of the discharge valve element 25 can be moved away from the above-mentioned closed position to an open position thereof shown by a solid line in FIG. 4. At the initial stage of the movement of the respective reed-valves 25*a* of the discharge valve element 25 from the closed position to the open position thereof, a free end of each reed-valve 25*a* is stopped by a stop 31. The stop 31 is formed as a local projection radially projecting from the circumference of the inner face of the rear housing 6 toward each of the discharge ports 21. Each stop 31 is provided with a flat stop face 31*a* to define a predetermined open position of the reed-valve 25*a* by a contact engagement thereof with the free end of the reed-valve 25*a*.

The above-mentioned wall 30 of the rear housing 6 is provided with a plurality of radial projections 32, i.e., five projections, extending radially therefrom toward the respective stops 31. Each radial projection 32 has an inclined support face 32*a* permitting the reed-valve 25*a* to lie thereon at a base portion thereof while preventing the base portion of the reed-valve 25*a* from being strongly bent. Namely, each inclined support face 32*a* of each radial projection 32 is formed so as to allow gradual bending of the reed-valve 25*a* when it is moved from the closed position to the open position. Thus, the reed-valves 25*a* of the discharge valve element 25 does not break from metal fatigue over a long operational life of the discharge valve element 25. It should be understood that the discharge valve element 24 having a plurality of reed-valves 24*a* on the front side of the compressor is provided with the same valve open position defining means as the above-described valve open position defining means of the rear discharge valve mechanism.

The operation of the compressor provided with the above-described discharge valve mechanism will be described below.

When the drive shaft 9 is rotated about the axis of rotation thereof together with the swash plate 10, the double headed pistons 12 reciprocate in the respective cylinder bores 11 to implement suction, compression, and discharge of the refrigerant gas. Namely, when the compressor is operated and the low pressure refrigerant gas passes from the external refrigerating system into the swash plate chamber 8, the refrigerant gas flows into the suction chambers 14 and 15 through front and rear suction passageways 28 and 29. Then, the refrigerant gas passes into the respective cylinder bores 11 due to the suction operation of the respective double-headed pistons 12 and the opening of the associated suction valve elements 22 and 23. The refrigerant gas is subsequently compressed by the compressing operation of the double-headed pistons 12 within the respective cylinder bores 11 to a high pressure. When the pressure of the compressed refrigerant gas reaches a predetermined pressure level sufficient for opening the reed-valves 24*a* and 25*a* of the discharge valve elements 24 and 25, the reed-valves 24*a* and 25*a* are moved from the closed position thereof toward the open position thereof, to permit the compressed refrigerant gas to be discharged from the respective cylinder bores 11 into the front and rear discharge chambers 16 and 17, via the discharge ports 20 and 21 respectively.

Figure 4:
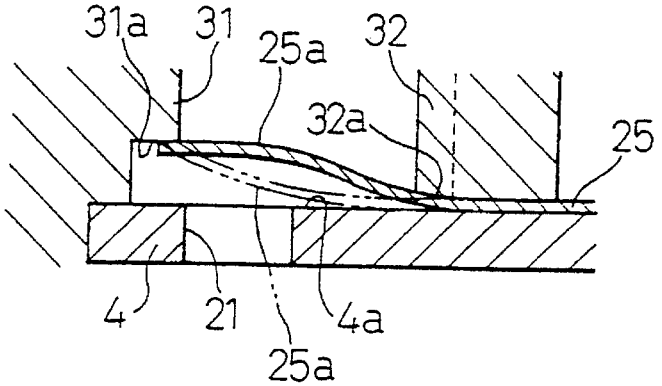
FIG. 4 is an enlarged cross-sectional partial view of the discharge valve mechanism incorporated in the compressor of FIG. 1, illustrating the open position of one of the discharge reed-valves of the valve mechanism with respect to a discharge port; and, FIG. 5 is a partial cross-sectional view similar to FIG. 4, illustrating the open position of the discharge reed-valve of the discharge valve mechanism according to the prior art.
Figure 5:
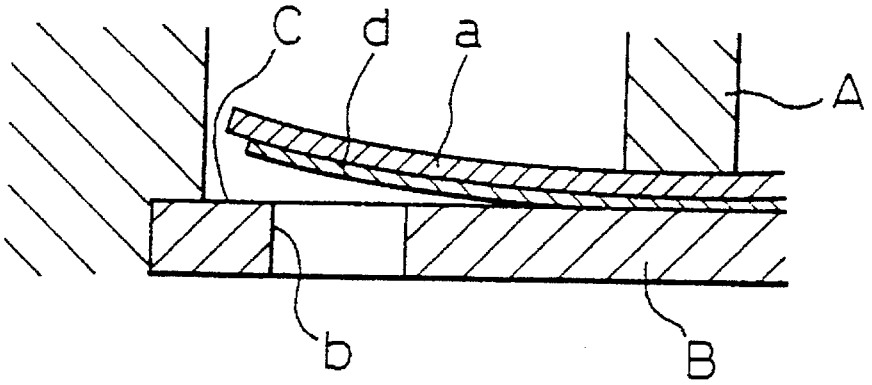
Fig. 5 (PRIOR ART)

At this stage, as typically shown in FIG. 4, the reed-valves, e.g., the reed-valve 25*a*, is initially resiliently moved away from the valve seat face 4*a* of the valve plate 4. During the initial movement, the reed valve 25*a* maintains the form of an inwardly bent bow as shown by a chain line, in FIG. 4 with respect to the valve seat face 4*a*, until the free end of the reed-valve 25*a* contacts the flat stop face 31*a* of the stop 31. Thereafter, the reed-valve 25*a* of the discharge valve element 25 is further moved by the pressure of the compressed refrigerant gas so as to assume the form of an outwardly bent bow as shown by the solid line in FIG. 4 to provide a large flow passageway for the compressed refrigerant gas discharged from the cylinder bores 11. The compressed refrigerant gas can be smoothly discharged from the cylinder bores 11 into the discharge chamber 17 without appreciable flow resistance thereto. Due to the lower flow resistance the power required from the external drive source for driving the compressor can be significantly reduced in comparison with the conventional discharge valve mechanism shown in FIG. 5.

Further, the described valve open position defining means of the discharge valve mechanism for the reciprocating piston type compressor, according to the present invention can eliminate the use of the valve retainer elements. The absence of valve retainer elements results in a reduction in the parts and assembling processes of the compressor. Furthermore, the valve open position defining means, i.e., the stops 31 having the flat stop faces 31*a* formed by the projections of the front and rear housings 5 and 6, and the inclined support faces 32*a* of the radial projections 32 can be accurately produced by mechanical machining. Thus, the valve open position of the reed-valves 24*a* and 25*a* of the discharge valve elements 24 and 25 can be accurately defined, and held constant.

It should be understood that the projections 32, having the inclined support faces 32*a*, permit the reed-valves 24*a* and 25*a* of the discharge valve elements 24 and 25 to be smoothly bent when the reed-valves 24*a* and 25*a* are moved away from the valve seat faces of the front and rear valve plates 3 and 4 to thereby prevent the discharge valve elements 24 and 25 from being damaged by fatigue. Long operational life of the discharge valve elements 24 and 25 can be assured.

Figure 3:
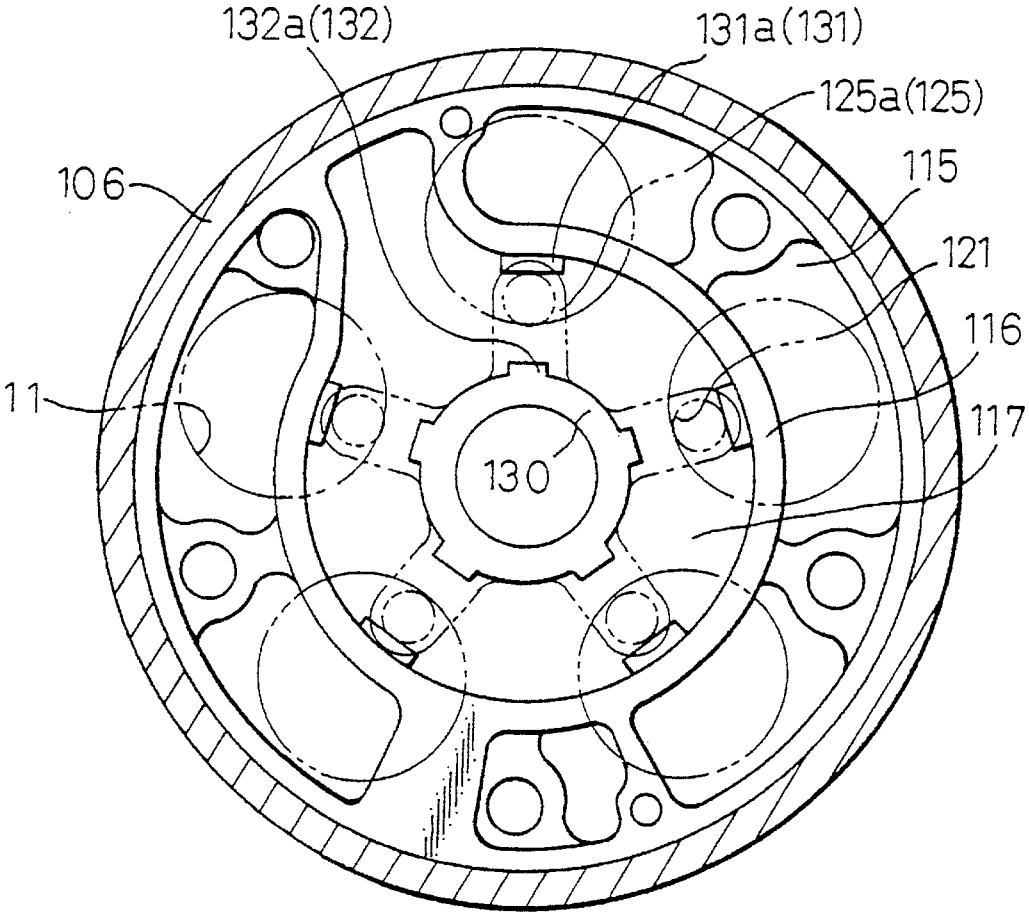
FIG. 3 is a side view of a rear housing of a reciprocating piston type compressor according to another embodiment of the present invention.

FIG. 3 illustrates another embodiment of a novel discharge valve mechanism for a reciprocating piston type compressor.

A housing of FIG. 3, i.e., a rear housing 106 is provided with an outer suction chamber 115, and an inner discharge chamber 117 surrounded by the outer suction chamber 115. The outer and inner chambers 115 and 117 are fluidly isolated from one another by a separating wall 116. The discharge chamber 117 is arranged between the above-mentioned separating wall 116 and an inner circular wall 130 formed in the inner face of the rear housing 106. The circular wall 130 and the outer face of the rear valve plate (it is not shown in FIG. 3 but is similar to the rear valve plate 4 of FIG. 1) is used for holding a discharge valve element 125 between the rear valve plate 4 and the circular wall 130 per se. The discharge valve element 125 is provided with a plurality of resiliently movable reed-valves 125*a* formed to radially extend from a base portion of the discharge valve element 125 toward respective discharge ports 121 formed in the rear valve plate.

The outer separating wall 116 is provided with a plurality of local projections protruding therefrom into the discharge chamber 117 toward the respective discharge ports 121, to provide valve stops 131, for defining predetermined open positions for the reed-valves 125*a* of the discharge valve element 125. Each of the stops 131 is provided with a flat stop face 131*a* formed therein. A free end of each reed-valve 125*a* abuts against stop face 131*a* when the reed-valve 125*a* is moved from its closed position toward its open position. When the free end of the reed-valve 125*a* is in contacting engagement with the flat stop face 131*a* of one of the stops 131, the open position of the reed-valve 125*a* is determined so that the reed-valves 125*a* can be bent to provide a large flow passageway for the compressed refrigerant gas discharged from the cylinder bores via the discharge ports 121. The stops 131, formed by the projections of the rear housing 106, operate in a manner similar to that of the stops 31 of the previous embodiment.

The circular wall 130 of the rear housing 106 is provided with a plurality of local projections 132 extending radially from the outer face of the circular wall 130 toward the respective stops 131. The projections 132 support the respective reed-valves 125*a* of the discharge valve element 125. The respective local projections 132 are provided with inclined support faces 132*a* similar to the inclined support faces 32*a* of the projections 32 of the previous embodiment. The inclined support faces 132*a* support the rear faces of the reed-valves 125*a* of the discharge valve 125, and permit the reed-valves 125*a* to lie on the inclined support faces 132*a*. The inclined support faces 132*a* allow gradual bending of the reed-valves 125*a* when they are moved from the closed position to the open position thereof by the high pressure of the compressed refrigerant gas discharged from the cylinder bores via the discharge ports 121.

It should be understood that the discharge valve mechanism according to the present embodiment includes a valve open position defining means similar to that shown in FIG. 3 on the front side of the reciprocating piston type compressor.

It should also be understood that the discharge valve mechanism of the above-described embodiment can enjoy the same advantages as those of the first-mentioned embodiment of the present invention.

Although the described embodiments are directed to double-headed reciprocating piston type constant capacity refrigerant compressor, the present invention is equally applicable to the discharge valve mechanisms for other types of reciprocating piston type compressors such as a single-headed piston type variable capacity refrigerant compressor, and a double-headed reciprocating piston type variable capacity refrigerant compressor.

From the foregoing description of the preferred embodiments of the present invention, it will be understood that the discharge valve mechanism for a reciprocating piston type compressor, can reduce the flow resistance applied to the compressed refrigerant gas discharged from the respective cylinder bores into the discharge chambers via the discharge ports. Accordingly, the load applied to the drive source of the compressor can be reduced which results in a remarkable reduction in the drive power loss of the drive source.

Further, the discharge valve mechanism according to the present invention eliminates the need for valve retainer elements and thus, contributes to a reduction in the parts and the assembling processes necessary for the assembly of the reciprocating piston type compressor. A reduction in the manufacturing cost of the reciprocating piston type can be realized.

The discharge valve mechanism according to the present invention can be accurate in the operation thereof, due to accurate definition of the valve open position by the machined valve open position defining means. Moreover, the discharge valve mechanism according to the present invention is provided with a support means for permitting the reed-valves of the discharge valve element to be smoothly bent during the movement of the discharge valve element from its closed position to the open position and the reed-valves of the discharge valve element do not suffer from damage due to mechanical fatigue over a long operational life of the discharge valve element.

Many variations and modifications will occur to persons skilled in the art without departing from the scope and spirit of the invention claimed in the accompanying claims.

What we claim:

1. A reciprocating piston type compressor comprising:

a cylinder block having therein a shaft bore and a plurality of cylinder bores arranged around said shaft bore;

an end wall means covering the ends of said cylinder bores of said cylinder block;

a drive shaft rotatably supported in said shaft bore via anti-friction bearings, and supporting thereon a swash plate element;

a plurality of pistons operatively engaged with said swash plate element and reciprocating in said plurality of cylinder bores for implementing suction, compression, and discharge of a refrigerant gas in response to rotation of said drive shaft;

at least a housing, arranged with said end wall means, to close an end of said cylinder block, said housing having an inner face, a suction chamber, a discharge chamber and a first wall extending from said inner face of said housing between said suction chamber and said discharge chamber said discharge chamber receiving compressed refrigerant gas discharged from each of said plurality of cylinder bores through each of a plurality of discharge ports bored in said end wall means;

a suction valve element arranged between said suction chamber and said respective cylinder bores, said suction valve element operative to close and open each of a plurality of suction ports bored in said end wall means;

a discharge valve element arranged between said housing and said end wall means, including a plurality of movable discharge reed-valves, in communication with said discharge chamber, operative to close and open said discharge ports, each of said movable discharge reed-valves having a free end; and, valve stop means integrally formed in said inner face of said housing at positions exposed to said discharge chamber and facing said free end of each of said movable discharge reed-valves, said valve stop means being arranged to engage said free end of each of said plurality of discharge reed-valves, to thereby determine an open position of each of said discharge reed-valves when each movable discharge reed-valve is moved from a closed position thereof to said open position thereof;

wherein said housing is provided with a plurality of supporting portions formed on said inner surface thereof at positions facing a base portion of each of said movable discharge reed-valves, to provide for a gradual bending of said movable discharge reed-valves when said plurality of movable discharge reed-valves are moved from said closed positions to said open positions thereof.

2. A reciprocating piston type compressor according to claim 1 wherein said discharge chamber of said housing is disposed radially outside of said first wall wherein said valve stop means is integrally formed in a part of said inner surface of said housing at positions exposed to said discharge chamber, wherein said supporting portions are integrally formed on a radially outer surface of said first wall.

3. A reciprocating piston type compressor according to claim 1, wherein said housing further has a second wall extended from said inner surface thereof and disposed radially inside said first wall thereof, wherein said discharge chamber is disposed radially inside said first wall, but outside said second wall, wherein said valve stop means is integrally formed on a radially inner face portion of said first wall, and wherein said supporting portions are integrally formed on a radially outer face of said second wall.

4. A reciprocating piston type compressor according to claim 3, wherein each of said plurality of supporting portions comprises a protrusion formed in said inner wall of said housing confronting each of said movable discharge reed-valves, and having an inclined support face thereof for supporting only a radial base portion of each of said movable reed-valves.

5. A reciprocating piston type compressor comprising:

a cylinder block having therein a central shaft bore and a plurality of cylinder bores arranged around the shaft bore, said cylinder block having a front end and a rear end;

a drive shaft rotatably supported in said central shaft bore via anti-friction bearings, and supporting thereon a swash plate element so as to be rotated together with said drive shaft;

a plurality of pistons operatively engaged with said swash plate element and reciprocating in said plurality of cylinder bores for implementing suction, compression, and discharge of a refrigerant gas in response to rotation of said drive shaft and said swash plate element;

a front housing arranged with a front end wall means to close the front end of said cylinder block, said front housing having an inner wall defining a front suction chamber for receiving a refrigerant gas to be compressed and said inner wall and an interior surface defining a front discharge chamber for receiving compressed refrigerant gas discharged from said plurality of cylinder bores through a plurality of front discharge ports bored in said front end wall means covering said front end of said cylinder bores;

a rear housing arranged with a rear end wall means to close the rear end of said cylinder block, said rear housing having an inner wall defining a rear suction chamber for receiving a refrigerant gas to be compressed and said inner wall and an interior surface defining a rear discharge chamber for receiving compressed refrigerant gas discharged from said plurality of cylinder bores through a plurality of rear discharge ports bored in said rear end wall means covering said rear end of said cylinder bores;

a front suction valve element arranged between said front end wall means and said cylinder block, said front suction valve element including a plurality of movable suction reed-valves, in communication with said suction chamber, of said front housing operative to close and open suction ports bored in said front wall means for communication between said suction chamber and said cylinder bores;

a front discharge valve element arranged between said front housing and said front end wall means, including a plurality of movable discharge reed-valves operative to close and open said front discharge ports, each movable discharge valves having a free end thereof;

a rear suction valve element arranged between said rear end wall means and said cylinder block, said rear suction valve element including a plurality of movable suction reed-valves, in communication with said suction chamber of said rear housing, operative to close and open suction ports bored in said rear end wall means to provide communication between said rear suction chamber and said cylinder bores;

a rear discharge valve element arranged between said rear housing and said rear end wall means, and including a plurality of movable discharge reed-valves operative to close and open said rear discharge ports, each of said movable discharge valves having a free end thereof;

a plurality of front discharge valve stop means integrally formed in said interior surface of said front housing at positions exposed to said front discharge chamber, said front valve stop means arranged to engage said free ends of each of said discharge reed-valves to thereby determine an open position of said discharge reed-valves when said discharge reed-valves are moved from a closed position to said open position; and a plurality of rear valve stop means integrally formed in said interior surface of said rear housing at positions exposed to said rear discharge chamber, said rear valve stop means being arranged to engage said free end of each of said plurality of discharge reed-valves to thereby determine an open position of each of said discharge valves when said movable discharge reed-valves are moved from a closed position to said open position, wherein said inner walls of said front and rear housings are provided with a plurality of supporting portions arranged at positions facing each of said movable discharge reed-valves of said front and rear discharge valve elements so as to provide a gradual bending of said movable discharge reed-valves when said plurality of movable discharge reed-valves are moved from said closed position to said open position within each of said front and rear discharge chambers, and wherein each of said plurality of supporting portions comprises a protrusion formed on said inner wall of each of said front and rear housings facing each of said movable discharge reed-valves, and having an inclined support face thereof for supporting only a radial base portion of each of said movable reed-valves.

6. A reciprocating piston type compressor according to claim 1 wherein said valve stop means comprises a plurality of projections radially projecting from a circumference of said inner face of said housing so as to define a plurality of flat seating faces which engage said free ends of said plurality of movable discharge reed-valves in face-to-face contact when said discharge reed-valves are moved to said open position.

7. A reciprocating piston type compressor comprising:

a cylinder block having therein a shaft bore and a plurality of cylinder bores arranged around the shaft bore;

an end wall means covering the end of each of said cylinder bores of said cylinder block;

a drive shaft rotatably supported in said shaft bore via anti-friction bearings, and supporting thereon a swash plate element;

a plurality of pistons operatively engaged with said swash plate element and reciprocating in said plurality of cylinder bores for implementing suction, compression, and discharge of a refrigerant gas in response to the rotation of said drive shaft;

a housing closing an end of said cylinder block and having a suction chamber and an interior surface and an inner wall defining a discharge chamber for receiving compressed refrigerant gas discharged from each of said plurality of cylinder bores through each of a plurality of discharge ports bored in said end wall means;

a suction valve element arranged between said cylinder block and said end wall means, said suction valve element including a plurality of movable suction reed-valves operative to close and open each of a plurality of suction ports bored in said end wall means;

a discharge valve element arranged between said housing and said end wall means, said discharge valve element including a plurality of movable discharge reed-valves operative to close and open said discharge ports, each of said movable discharge valves having a free end and a radial base portion, said inner wall of said housing being provided with a plurality of supporting means having an inclined support face for supporting only said radial base portion of each of said movable reed-valves; and valve stop means integrally formed in said interior surface of said housing at positions exposed to said discharge chamber, said valve stop means arranged to engage said free end of each of said discharge reed-valves to thereby determine an open position of each of said discharge reed-valves when each discharge reed-valve is moved from a closed position to said open position.

* * * * *